US008358087B2

(12) United States Patent
Tran et al.

(10) Patent No.: US 8,358,087 B2
(45) Date of Patent: Jan. 22, 2013

(54) ALTERNATING TURN OFF TIMING OF A FLUORESCENT LAMP STARTER UNIT

(75) Inventors: Quyen Tran, Morgan Hill, CA (US); Yefim Gluzman, San Francisco, CA (US); Kamlapati Khalsa, San Jose, CA (US)

(73) Assignee: ZiLOG, Inc., Milpitas, CA (US)

( * ) Notice: Subject to any disclaimer, the term of this patent is extended or adjusted under 35 U.S.C. 154(b) by 444 days.

(21) Appl. No.: 12/803,308

(22) Filed: Jun. 22, 2010

(65) Prior Publication Data

US 2011/0309763 A1 Dec. 22, 2011

(51) Int. Cl.
*H05B 37/00* (2006.01)

(52) U.S. Cl. ..... 315/307; 315/360; 315/DIG. 5

(58) Field of Classification Search ..... 315/DIG. 2, 315/DIG. 5, DIG. 7, 360, 362, 224, 291, 315/307, 308

See application file for complete search history.

(56) References Cited

U.S. PATENT DOCUMENTS

| | | | | |
|---|---|---|---|---|
| 5,187,411 | A * | 2/1993 | Boyd et al. | 315/247 |
| 6,483,260 | B1 * | 11/2002 | Flory, IV | 315/325 |
| 6,859,644 | B2 | 2/2005 | Wang | 455/159.2 |
| 7,061,188 | B1 * | 6/2006 | Katyl et al. | 315/291 |
| 7,307,542 | B1 | 12/2007 | Chandler et al. | 340/825.52 |
| 7,446,671 | B2 | 11/2008 | Giannopoulos et al. | 340/825.72 |
| 7,528,558 | B2 * | 5/2009 | Yu et al. | 315/308 |
| 7,554,274 | B2 | 6/2009 | Wang et al. | 315/317 |
| 2006/0044152 | A1 | 3/2006 | Wang | 340/825 |
| 2009/0026966 | A1 | 1/2009 | Budde et al. | 315/152 |

OTHER PUBLICATIONS

Sinem Coleri Ergen, "ZigBee/IEEE 802.15.14 Summary", Sep. 10, 2004, pp. 1-35.

Mikhail Galeev, "Embedded Systems Programming: Will Bluetooth, ZigBee, and 802.11 all have a place in your home? Here's what ZigBee offers for home wireless networking", Apr. 20, 2004, pp. 1-6.

Dan Strassberg, "Simple networks will free many sensors from wires", Apr. 13, 2006, pp. 2-3.

G. Bhatti, A. Mehta, Z. Sahinoglu, J. Zhang, and R. Viswanathan, "Modified Beacon-Enabled IEEE 802.15.4 MAC for Lower Latency", Apr. 2009, pp. 1-6.

Jeffrey Z. Tao, Shivendra S. Panwar, Daqing Gu, Jinyun Zhang, "Performance Analysis for the IEEE 802.15.4 Contention Access Period", downloaded Sep. 2009, pp. 2-19.

Atmel Corporation, "ATAVRFBKIT/EVLB001 Dimmable Fluorescent Ballast User Guide", Oct. 2007, pp. 1-32.

(Continued)

*Primary Examiner* — David H Vu

(74) *Attorney, Agent, or Firm* — Imperium Patent Works; T. Lester Wallace

(57) ABSTRACT

A starter unit (for example, an RF-enabled and replaceable starter unit) has an ability both to turn on and to turn off a fluorescent lamp. The starter unit detects whether a ballast in the circuit with the fluorescent lamp is of a first type (for example, an L-type ballast) or is of a second type (for example, a C-type ballast). If the determination is that the ballast is of the first type, then the starter unit turns off the lamp in a first way (for example, using C-type timing and then using L-type timing alternatingly). If the determination is that the ballast is of the second type, then the starter unit turns off the lamp in a second way (for example, using only C-type timing). The same starter unit design is usable both in single-lamp fixtures and in multi-lamp fixtures where a mix of ballast types may be used.

20 Claims, 10 Drawing Sheets

TURN-OFF OF MULTIPLE FLUORESCENT LAMPS

OTHER PUBLICATIONS

Bob Nelson and Chris Marshall, "Request for Specification Input (RSI) Technical Requirements Document", Apr. 26, 2000, pp. 2-19.
Patrick Kinney, "ZigBee Technology: Wireless Control that Simply Works", Oct. 2, 2003, pp. 2-21.
Bob Heile, "Wireless Sensors and Control Networks: Enabling New Opportunities with ZigBee", Dec. 2006, pp. 2-52.
Royal Philips Electronics, Samsung Electronics Co., Ltd., Sony Corporation and ZigBee Alliance, "Zigbee and RF4CE Set New Course for Consumer Electronic Remote Controls", Mar. 3, 2009, pp. 1-3.
Bo Gao and Chen He, "An Individual Beacon Order Adaptation Algorithm for IEEE 802.15.4 Networks", May 2008, pps. 12-16.
Francis Rubenstein, "After DALI: A Look at What's Next", Jan. 16, 2005, pp. 3-4.
Dali Specification Guide, downloaded Sep. 2009, pp. 5-71.
Daintree Networks, "Introducing ZigBee RF4CE", Apr. 2009, pp. 1-4.
Module: ZigBee Overview, downloaded Sep. 2009, pp. 1-34.
Yao-Jung Wen, "Wireless Sensor and Actuator Networks for Lighting Energy Efficiency and User Satisfaction", Fall 2008, pp. 1-261.
Liang Cheng, "IEEE 802.15.4 MAC Protocol Study and Improvement", Dec. 2007, pp. 1-86.

* cited by examiner

RF-ENABLED STARTER UNITS TURN-OFF FLUORESCENT LAMPS OF MULTI-LAMP LIGHT FIXTURE

TURN-OFF OF MULTIPLE FLUORESCENT LAMPS

LAMP IS ON

STARTER RECEIVES TURN OFF COMMAND

INITIATE TURN OFF - TURN ON THE SWITCH

INITIATE TURN OFF OF THE SWITCH AT THE APPROPRIATE TIME
(L-TYPE TIMING OR C-TYPE TIMING)

- ENABLE VOLTAGE CLAMP
- OPERATE SWITCH IN LINEAR MODE

OPERATE SWITCH IN LINEAR MODE UNTIL RECTIFIED VOLTAGE DECREASES TO A PREDETERMINED VOLTAGE

SWITCH IS FULLY OFF

LAMP TURN OFF IS COMPLETE

RF-ENABLED
STARTER UNIT

C-TYPE BALLAST - LAMP TURN OFF

L-TYPE BALLAST - LAMP TURN OFF

C-TYPE BALLAST - PREHEAT

L-TYPE BALLAST - PREHEAT

ALTERNATING TURN OFF TIMING OF A FLUORESCENT LAMP STARTER UNIT

TECHNICAL FIELD

The described embodiments relate to starter units for fluorescent lamps.

BACKGROUND INFORMATION

Fluorescent light fixtures include tubular fluorescent bulbs. A fluorescent bulb is also referred to here as a fluorescent lamp. The tube is a glass tube that contains an ionizable gas and a small amount of mercury. There are filaments at each end of the tube. Upon application of proper electrical voltages, the filaments can be made to heat up and to ionize the ionizable gas in the tube. If a voltage of adequate magnitude is then provided between the filaments, an electrical arc can be started through the gas in the tube between the filaments. The arc involves a flow of current from one filament, through the ionized gas, and to the other filament. Energetic electrons in this current flow collide with the mercury atoms, thereby exciting the mercury atoms and causing them to emit ultraviolet radiation. The emitted ultraviolet radiation is absorbed by and excites a phosphor coating on the inside of the walls of the tube. The phosphor coating fluoresces and emits radiation in the visible spectrum (i.e., visible light). The visible light passes outward through the glass and is usable for illuminating purposes.

Some such fluorescent light fixtures involve a circuit referred to as a "starter" or a "starter unit". In a first step, a switch in the starter unit closes and forms an electrical connection between the filament at one end of a tube and the filament at the other end of the tube such that an alternating current can flow from an AC power source, through an inductive ballast, through one filament, through the closed switch of the starter, and through the second filament, and back to the AC power source. This alternating current flow causes the filaments to heat. The heating of the filaments causes gas surrounding the filaments to ionize. Once the gas is ionized in this way, then the switch in the starter unit is opened. The opening of the switch cuts current flow through the inductive ballast, thereby causing a large voltage spike to develop. Due to the circuit topology, this large voltage is present between the two filaments. The voltage is large enough to strike an arc through the gas. Once the arc is established, the resistance between the two filaments through the gas decreases. This allows the current to continue to flow through the gas without a large voltage being present between the filaments. The switch is left open, the current continues to flow, filaments continue to be heated, the arc is maintained, and the current flow is regulated by the ballast. The fluorescent lamp is then said to be on. The lamp emits visible light to illuminate an area.

In fluorescent light fixtures, the starter unit may fail. The starter unit is therefore sometimes made to be a replaceable unit. Great numbers of fluorescent light fixtures with replaceable starter units are installed throughout the world. Large numbers of such fluorescent light fixtures are installed in public buildings, office buildings, and other large buildings. Quite often the fluorescent lights are left on and consume electrical energy even though the area served does not need to be illuminated. A way of preventing this waste of electrical energy is desired.

Infrared motion detecting wall switches are often employed to prevent the waste of energy due to lights being left on when lighting is not needed. If an infrared motion detector in the wall switch does not detect motion of an infrared emitter (for example, a human body) in the vicinity of the wall switch, then circuitry in the wall switch determines that the room is not occupied by a person. Presumably if a person were in the room, the person would be moving to some extent and would be detected as a moving infrared emitter. If the wall switch determines that the room is unoccupied because it does not detect any such moving infrared emitter, then the wall switch turns off the fluorescent lights on the circuit controlled by the wall switch. The wall switch turns off the fluorescent lights by cutting AC power flowing to the fluorescent lamp light fixtures through power lines hardwired into the building. If, however, the wall switch detects a moving infrared emitter, then the wall switch turns on the lights by energizing the hardwired power lines so that AC power is supplied to the fluorescent light fixtures through the hardwired power lines.

The wall switch motion detection system involving hardwired power lines embedded in the walls and ceilings of buildings is quite popular, but a wireless system has been proposed whereby each of the replaceable starter units is to be provided with an RF receiver. The starter unit is then to turn on or off the fluorescent lamp of its light fixture in response to RF commands received from a central motion detecting occupancy detector. If a person enters a room provided with such a system, then the central motion detector detects motion and issues RF commands to the starter units in the light fixtures to turn on their respective fluorescent lamps. If the central motion detector fails to detect motion for an amount of time and determines that the room is not occupied, then the central motion detector issues RF commands to the starter units to turn off their respective fluorescent lamps, thereby preventing wasted electrical power that would otherwise be consumed illuminating the unoccupied room.

In a proposed system, different timing is to be employed in a starter unit to turn off a fluorescent lamp depending on the type of ballast being used. There are many types of ballasts used to limit current flow through fluorescent lamps including ballasts referred to here as L-type ballasts and including ballasts referred to here as C-type ballasts. An L-type ballast is generally an inductor whereas a C-type ballast is an inductor that includes a series capacitor. In the proposed system, each starter unit attempts to detect the type of ballast to which it is connected. If the starter unit detects it is connected to an L-type ballast, then it uses turn off timing more appropriate for lamps having L-type ballasts. If the starter unit detects it is connected to a C-type ballast, then it used turn off timing more appropriate for lamps having C-type ballasts. Often times a light fixture employing multiple lamps will include one L-type ballast and one C-type ballast so that the overall power factor of the light fixture is suitable. The starter units in the fixture of the proposed system therefore would use different timings to turn off the lamps. Other times a light fixture employing multiple lamps will include two C-type ballasts, or will include two L-type ballasts. The starter units in these fixtures of the proposed system would use the same timings to turn off the lamps.

SUMMARY

A starter unit (for example, an RF-enabled and replaceable starter unit) has an ability both to turn on a fluorescent lamp and to turn off the lamp. The starter unit detects whether a ballast in the circuit with the fluorescent lamp is of a first type (for example, a L-type ballast) or is of a second type (for example, a C-type ballast). In one novel aspect, the determination is made by determining a periodicity of a transient oscillatory response that results from turning on the switch of the starter unit during a preheat operation. If the determination is that the ballast is likely of the first type, then the starter unit turns off the lamp in a first way (for example, using C-type timing and then using L-type timing alternatingly). C-type timing may involve putting the switch of the starter unit into a linear mode of operation at the end of the turn off operation at a different time than does L-type timing. If, on the other hand, the determination is that the ballast is likely of the second type then the starter unit turns off the lamp in a second way (for example, using only C-type timing and using substantially no L-type timing).

In an example in which AC mains power is 230 volts and fifty hertz, in both the L-type and C-type turn off timings the switch of the starter unit is pulsed on for a duration of more than twenty milliseconds and less than fifty milliseconds, and this pulse on time is followed by a duration of less than ten milliseconds when the switch is operated in the linear mode.

Using the novel alternative pattern turn off method, the same starter unit design is usable both in single-lamp light fixtures and in multi-lamp light fixtures where a mix of ballast types may be used. If a multi-lamp light fixture involves both an L-type ballast and a C-type ballast, then the lamp provided with the C-type ballast will only be turned off using C-type turn off timing that is safe for the switch in the starter unit. The lamp provided with the L-type ballast will experience an initial turn off attempt using C-type timing. Use of C-type timing increases the chance that both lamps will be turned off simultaneously without a later turn off operation erroneously re-igniting a previously turned off lamp. If the lamp does not turn off, however, due to the use of weaker C-type turn off timing on a lamp coupled to a L-type ballast, then a later turn off attempt on the lamp will use L-type timing. In situations in which a starter unit of this design is used in a single-lamp light fixture, a lamp coupled to a L-type ballast will experience, in addition to C-type turn off timing, the more effective L-type turn off timing. A lamp in a single-lamp light fixture with a C-type ballast will experience only C-type turn off timing attempts.

Further details and embodiments and techniques are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

FIGS. 3-8 is a sequence of diagrams that illustrate steps in the turn off of a fluorescent lamp using a starter unit in the multi-lamp light fixture of. FIG. 1.

DETAILED DESCRIPTION

Reference will now be made in detail to background examples and some embodiments of the invention, examples of which are illustrated in the accompanying drawings.

Figure 1:
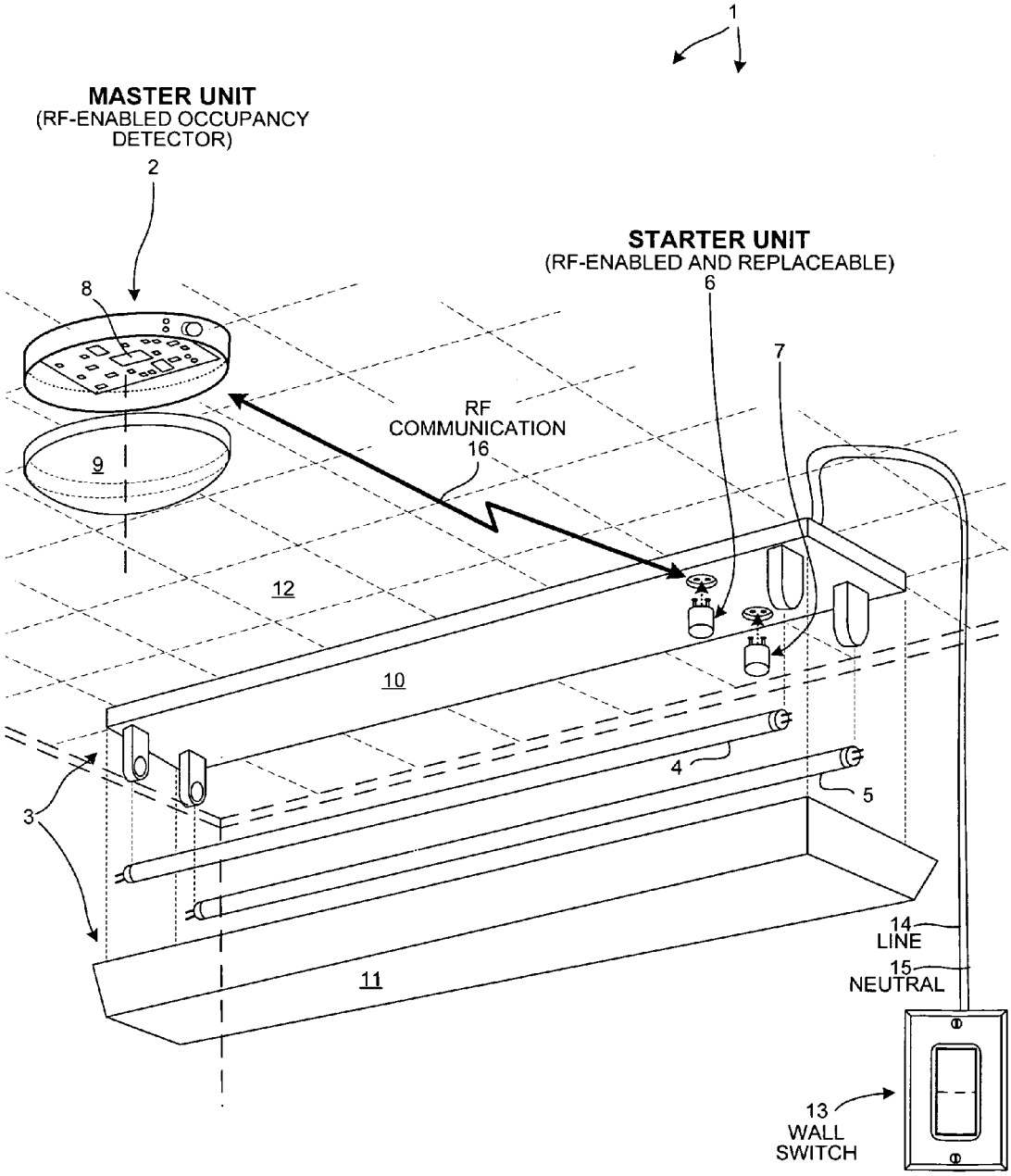
FIG. 1 is a perspective diagram of a system involving a multi-lamp light fixture, where the fluorescent lamps in the fixture can be turned off by RF-enabled and replaceable starter units.

FIG. 1 is a diagram of a system 1 for turning off a fluorescent lamp that includes a master unit 2 and a plurality of multi-lamp fluorescent light fixtures having fluorescent lamp starter units. For illustrative purposes, one multi-lamp fluorescent light fixture 3 is pictured in FIG. 1. Other multi-lamp fluorescent light fixtures of system 1 are not pictured. Multi-lamp fluorescent light fixture 3 includes two fluorescent lamps 4 and 5 and starter units 6 and 7 associated with each lamp, respectively. In this example, master unit 2 is an infrared occupancy detector involving a Passive InfraRed (PIR) sensor 8 and a multi-section fresnel lens 9. Using techniques well known in the art, master unit 2 detects motion of infrared emitters in the field of view of fresnel lens 9 and detects the lack of motion of such infrared emitter. If the master unit detects motion, then the master unit turns on or keeps on the fluorescent lamps of the fluorescent light fixtures of system 1. If, on the other hand, the master unit does not detect motion, then the master unit turns off the fluorescent lamps of system 1 to conserve electrical energy. In another example, master unit 2 includes an ambient light detector useable to indicate available ambient light. Based on the available ambient light, the master unit may turn off fluorescent lamps of the multi-lamp fixture 3 of system 1 to conserve electrical energy. In the illustration of FIG. 1, multi-lamp light fixture 3 includes a base portion 10, a translucent cover portion 11, the fluorescent bulbs or lamps 4 and 5, and their associated starter units 6 and 7, respectively. Ballasting inductances (not shown) are included with fluorescent lamps 4 and 5. Both the multi-lamp light fixture 3 and the master unit 2 are fixed to the ceiling 12 of a room in a building as shown. A wall switch 13 is connected by electrical wires 14 and 15 to all the light fixtures of system 1 in standard fashion so that a person in the room can manipulate the wall switch to turn on, and to turn off, the fluorescent lights. The electrical wires 14 and 15 are embedded in the walls and ceiling of the building. In the illustrated example, wire 14 is the LINE conductor, whereas wire 15 is the NEUTRAL conductor.

Master unit 2 has a radio-frequency (RF) transceiver (transmitter and receiver) for engaging in RF communication, including an RF communication 16 with the starter units 6 and 7 of system 1. As pictured, master unit 2 need not be connected to any hardwired electrical wiring in the building. The master unit 2 is a self-contained, battery-powered unit that is fixed to the ceiling 12 of the room illuminated by system 1. Master unit 2 can be easily fixed to ceiling 12 by application of adhesive tape or by a screw or other common attachment mechanism.

Figure 2:
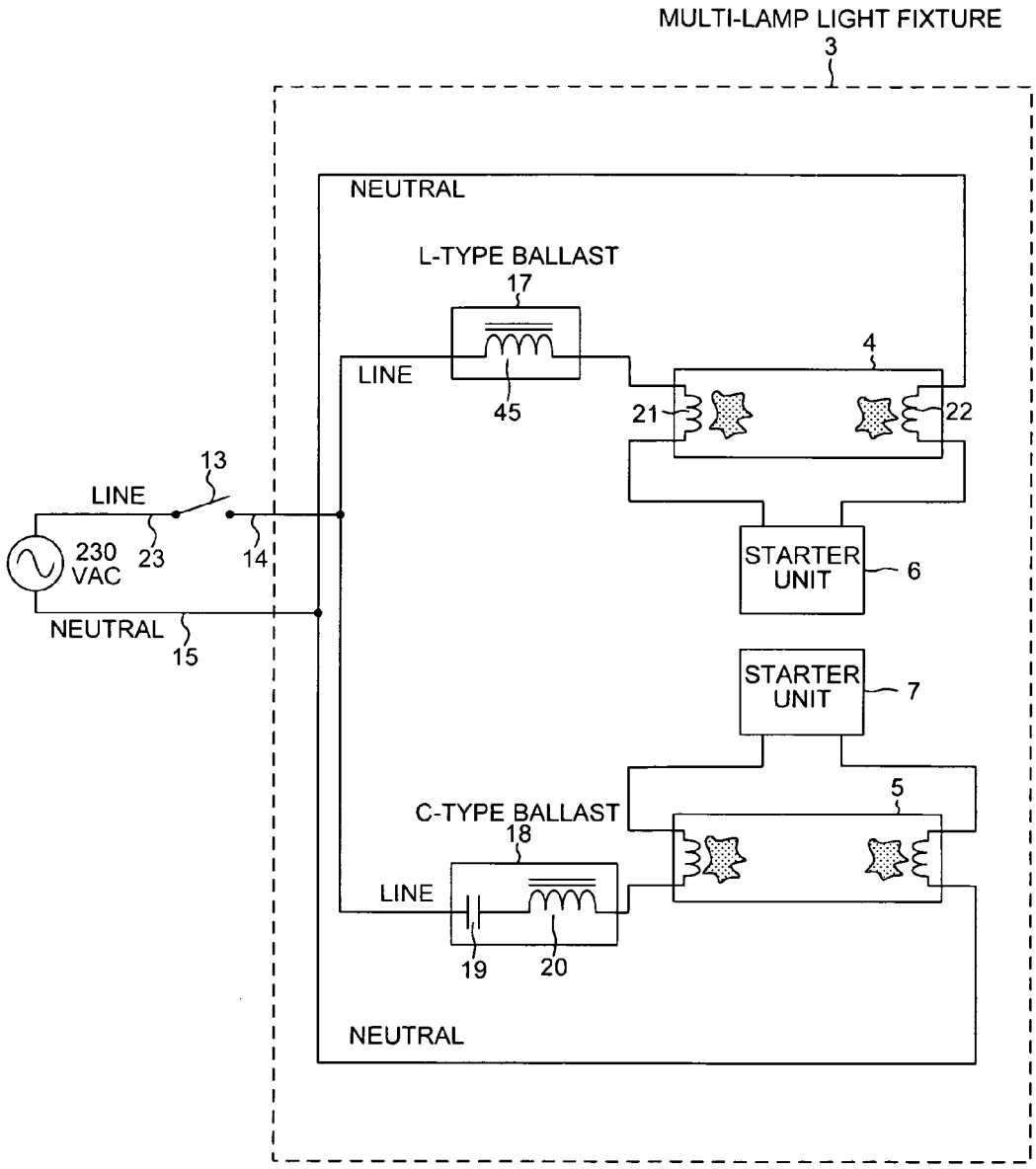
FIG. 2 is a simplified circuit diagram of the multi-lamp light fixture of FIG. 1.

FIG. 2 is a circuit diagram of multi-lamp light fixture 3 of FIG. 1. The lamp 4 is provided with an L-type ballast 17, whereas the lamp 5 is provided with a C-type ballast 18. The C-type ballast 18 includes a capacitor 19 in series with an inductor 20, whereas the L-type ballast 17 includes only an inductor 45 and no series-connected capacitor. To turn on lamp 4, for example, the starter unit 6 forms an electrical connection between filaments 21 and 22 of lamp 4. A current then begins to flow from the AC mains LINE conductor 23, through wall switch 13 (which is closed in this example), through conductor 14, through ballast 17, through filament 21, through starter unit 6, through filament 22, through NEUTRAL conductor 15 and back to the AC mains. The filament heats and ionizes the ionizable gas in lamp 4. The starter unit 6 is then made to open the electrical connection. When current stops in the inductor of ballast 17, the voltage between the filaments 21 and 22 rises rapidly, and this strikes an arc through the gas in the lamp between the filaments, thereby turning on the lamp. The same basic turn on process is used to turn on lamp 5.

Figure 3:
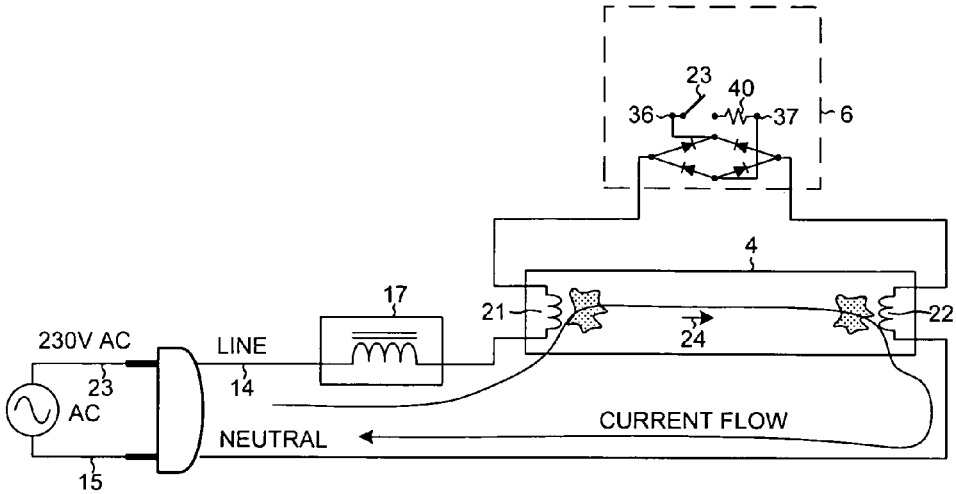
Figure 4:
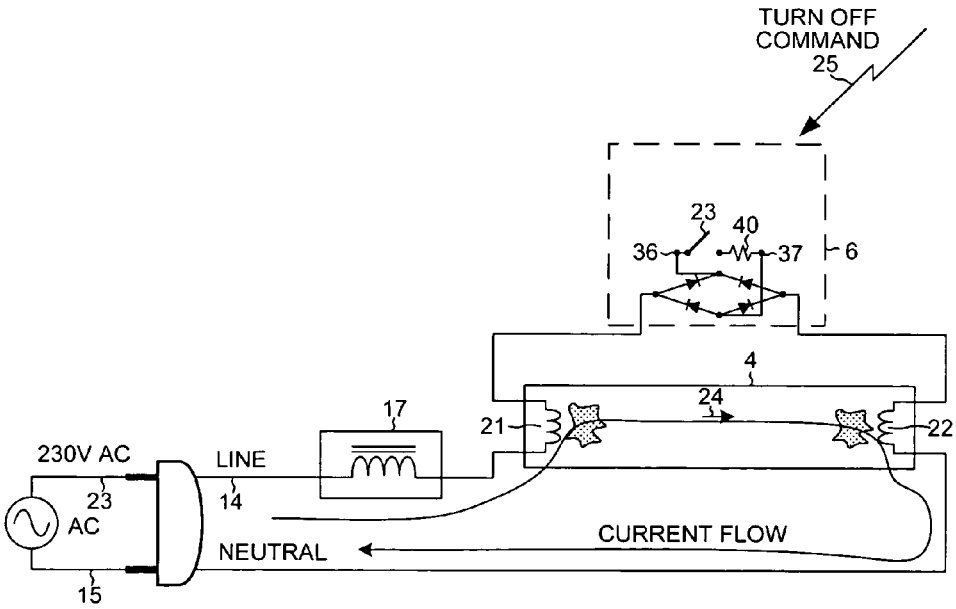
Figure 5:
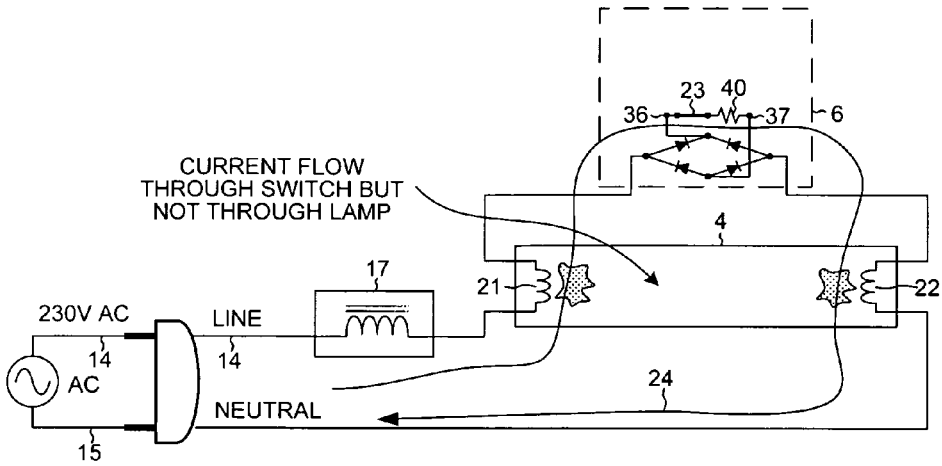
Figure 6:
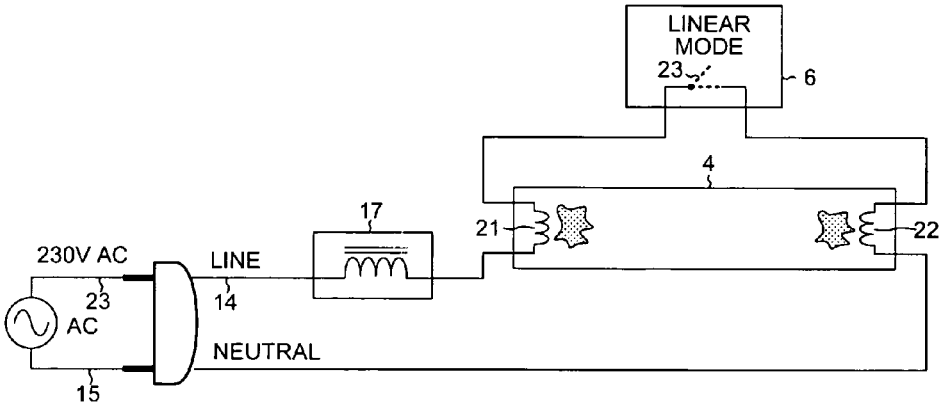
Figure 7:
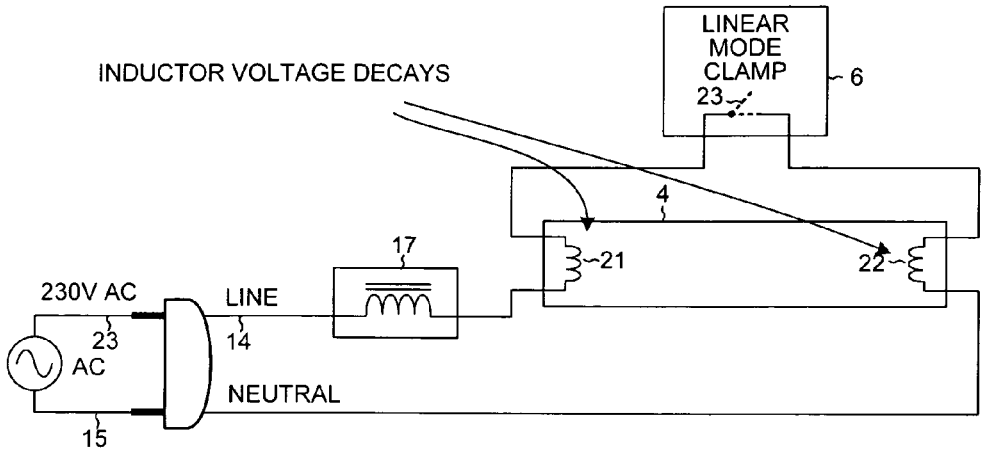
Figure 8:
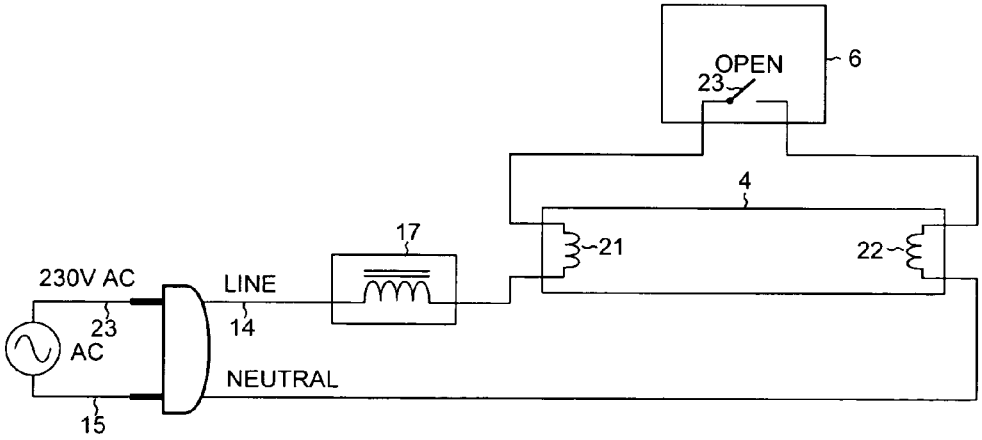

FIG. 3-8 illustrate steps in the process of turning off a lamp (for example, lamp 4) using a starter unit. Initially, lamp 4 is on as is illustrated in FIG. 3. A switch 99 in starter unit 6 is off (open). Current 24 flows through the lamp as illustrated. Next, as illustrated in FIG. 4, the turning off of lamp 4 is caused by receipt of a turn off command 25 received from master unit 2. Turn off command 25 instructs the starter unit 6 to turn off lamp 4. Next, as illustrated in FIG. 5, switch 99 closes such that current 24 now flows through the switch 99 in the starter unit and not through the lamp. Next, as illustrated in FIG. 6, the turn off of switch 99 is initiated. In this example, the switch is a MOS power transistor that is put into its linear mode of operation. A voltage clamp circuit is enabled and this is illustrated in FIG. 6 by showing switch 99 in a dashed representation. The voltage clamp circuit keeps switch 99 operating in its linear mode until the voltage across the filaments 21 and 22 drops to a predetermined voltage. Operation in the linear mode is illustrated in FIG. 7. When the voltage across the filaments drops sufficiently (as detected inside the starter unit by a rectified voltage falling to a predetermined voltage), then the voltage clamp circuit causes switch 99 to be fully turned off. As illustrated in FIG. 8, the switch 99 is fully off and the lamp 4 is off.

Figures 9, 10:
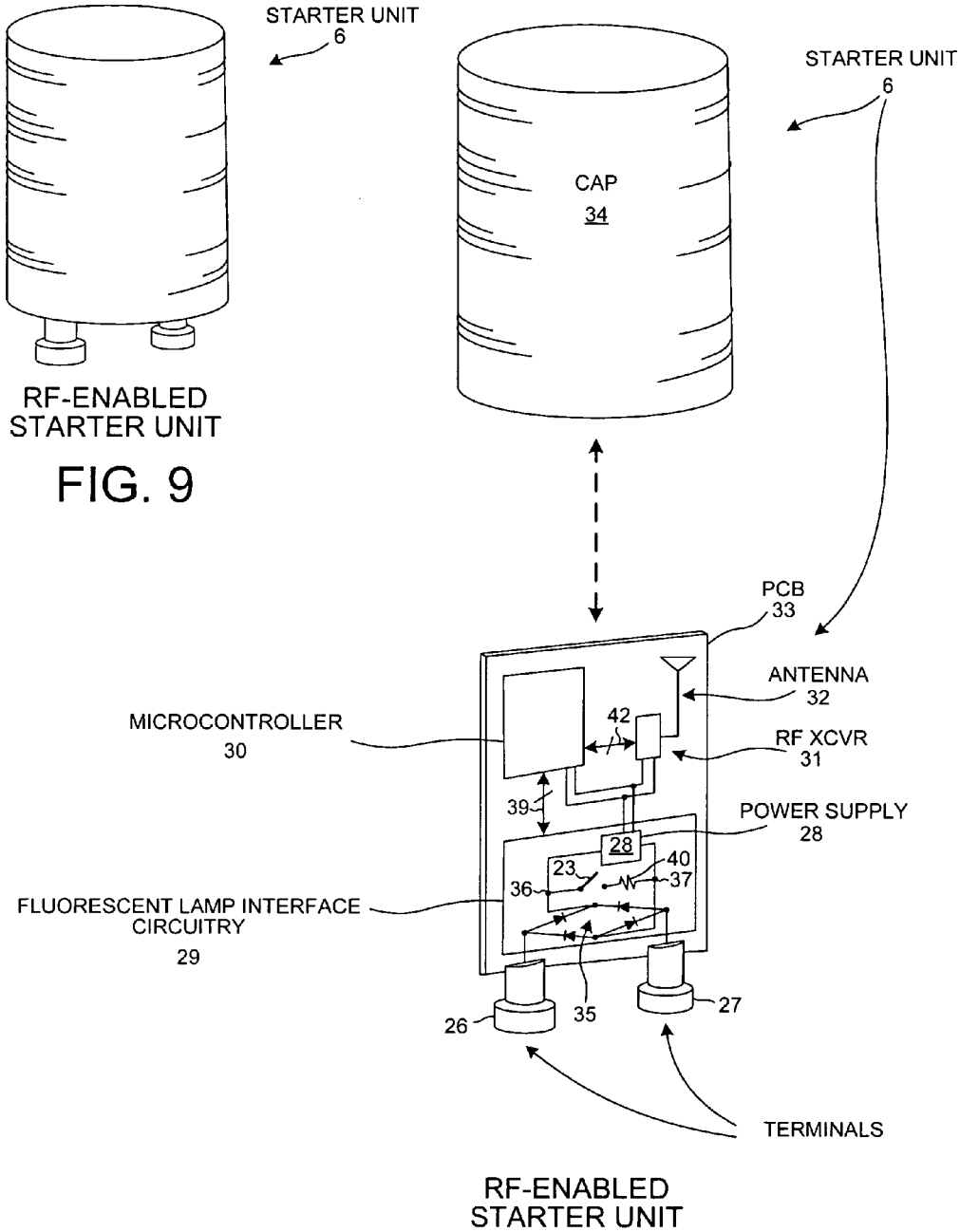
FIG. 9 is a perspective view of one of the RF-enabled starter units of the system of FIG. 1.
FIG. 10 is an exploded perspective view of the RF-enabled starter unit of FIG. 9.

FIG. 9 is a perspective view of starter unit 6.

FIG. 10 is an exploded perspective view of starter unit 6. Starter unit 6 includes a first terminal 26, a second terminal 27, a power supply 28, fluorescent lamp interface circuitry 29, a microcontroller integrated circuit 30, an RF transceiver 31 and an antenna 32. This circuitry is disposed on a printed circuit board (PCB) 33 as illustrated. PCB 33 is disposed within a cylindrical cap 34. Terminals 26 and 27 extend downward through holes in a circular disk-shaped base portion (not shown) of PCB material. The circular edge of this disk-shaped base portion joins with the circular bottom edge of cap 34 and forms a circular bottom of starter unit 6.

Fluorescent lamp interface circuitry 29 includes a full wave rectifier 35 that receives a 230-volt alternating-current (AC) signal between terminals 26 and 27 and outputs a full wave rectified signal (VRECT) between nodes 36 and 37. Power switch 99 is the switch that is used to turn on, and to turn off, fluorescent lamp 4. Power switch 99 is a power field effect transistor (FET) that is controlled by microcontroller 30 via gate drive circuitry of circuitry 29. Microcontroller 30 drives the control electrode (the gate in this case) of switch 99 and controls and monitors the remainder of interface circuitry 29 via signals communicated across conductors 39. Microcontroller 30 monitors and traces the alternating current and voltage waveforms between nodes 36 and 37 using an analog-to-digital converter (ADC) that is part of the microcontroller. Microcontroller 30 monitors and traces the waveform of the current flowing through switch 99 by using its ADC to monitor a voltage dropped across a sense resistor 40. Microcontroller 30 uses an on-board comparator and a timer to detect and time zero-crossings and minima of the AC signals on nodes of the circuitry 29. Microcontroller 30 determines when and how to control switch 99 based on the detected voltage and current between nodes 36 and 37, the time of the zero-crossings of the AC signal on terminals 26 and 27, and the magnitude of current flowing through switch 99.

Power supply 28 receives the full wave rectified signal between nodes 36 and 37 and generates therefrom a direct current (DC) supply voltage VDD used to power microcontroller 30, RF transceiver 31, and interface circuitry 29. Power supply 28 includes a capacitance that is charged to the DC supply voltage VDD. This capacitance is large enough that it continues to power the microcontroller and RF transceiver of the starter unit for more than five seconds after the 230-volt AC power is removed from terminals 26 and 27. If the starter unit 6 is installed in light fixture 3, and if wall switch 13 is toggled on and off faster than once every five seconds, then interface circuitry 29, microcontroller 30, and transceiver 31 remain powered and operational.

Microcontroller 30 communicates with and controls RF transceiver 31 via a bidirectional serial SPI bus and serial bus conductors 42. In one embodiment, microcontroller 30 is a Z8F2480 8-bit microcontroller integrated circuit available from Zilog, Inc., 6800 Santa Teresa Blvd., San Jose, Calif. 95119. Microcontroller 30 includes an amount of non-volatile memory (FLASH memory) that can be written to and read from under software control during operation of starter unit 6. In one embodiment, RF transceiver 31 is a SX1211 transceiver integrated circuit available from Semtech Corporation, 200 Flynn Road, Camarillo, Calif. 93012. Transceiver 31 is coupled to antenna 32 via an impedance matching network 43 and a SAW filter 44 (see FIG. 6). The SAW filter may, for example, be a B3716 SAW filter available from the Surface Acoustic Wave Components Division of EPCOS AG, P.O. Box 801709, 81617 Munich, Germany. Antenna 32 may, for example, be a fifty ohm 0868AT43A0020 antenna available from Johanson Technology, Inc., 4001 Calle Tecate, Camarillo, Calif. 93012. RF transceiver 31 operates in a license free frequency band in the 863-878 MHz range (for example, about 868 MHz), in accordance with a reference design available from Semtech Corporation. The RF antenna and transceiver of starter unit 6 can receive an RF communication 16 (see FIG. 1) from master unit 2. The data payload of the communication 16 is communicated across SPI bus conductors 42 to microcontroller 30 for processing.

Figure 11:
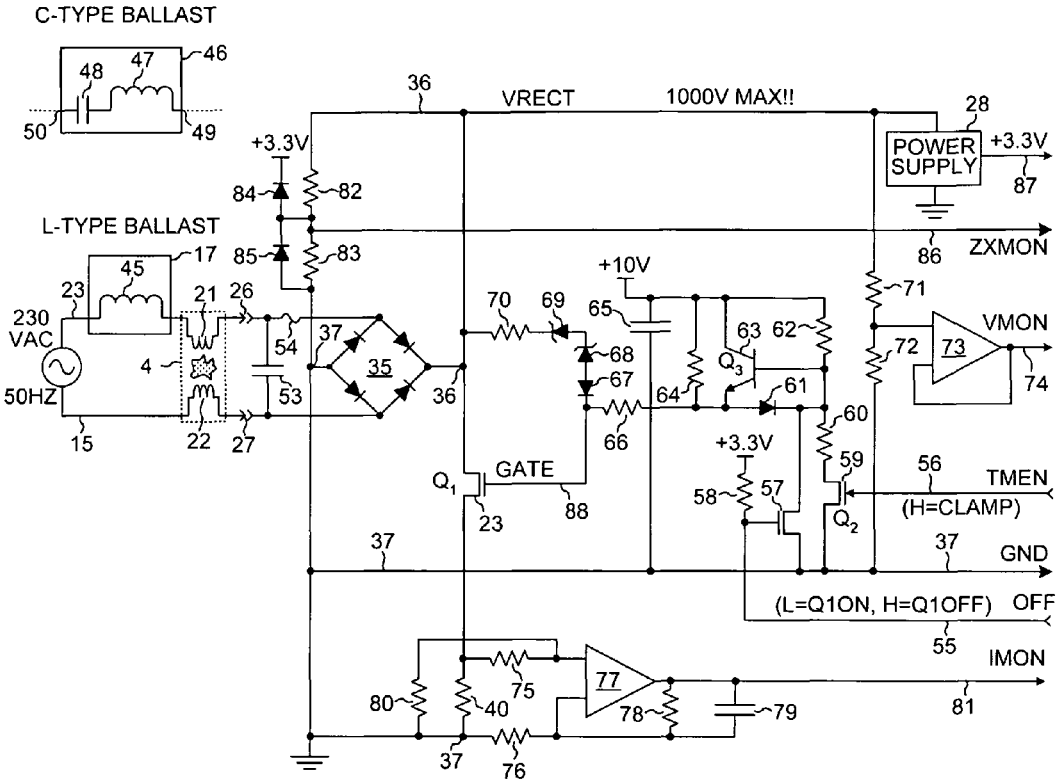
FIG. 11 is a circuit diagram of a first portion of the starter unit of FIG. 10.

FIG. 11 is a more detailed circuit diagram of starter unit 6. A 230-volt, 60-Hz alternating current (AC) mains voltage is present between conductors LINE conductor 23 and NEUTRAL conductor 15. L-type ballast 17 includes inductor 45 but no series capacitor, whereas the alternative C-type ballast 46 includes an inductor 47 and a series capacitor 48. If C-type ballast 46 were being used rather than L-type ballast 17, then terminal 49 of the ballast 46 would be connected to filament 21 of lamp 4 and terminal 50 would be connected to LINE conductor 23. A capacitor 51 is connected across terminals 26 and 27. Reference numeral 54 identifies a thermal fuse. AC voltage across terminals 26 and 27 is rectified by a full-wave rectifier 35 so that a rectified voltage signal RECT is present across nodes 36 and 37. Reference numeral 99 identifies the switch. The microcontroller 30 (see FIG. 12) can turn on and off this switch 99 by driving digital control signals OFF and TMEN onto conductors 55 and 56, respectively. Components 57-66 form a voltage translation and gate drive circuit for switch 99. Components 67-70 form a voltage clamp for clamping the gate voltage of switch 99. Signal TMEN being a digital high enables the voltage clamp. OFF being a digital high turns off switch 99. Microcontroller 30 monitors the voltage VRECT between nodes 36 and 37 using a voltage divider of resistors 71 and 72 and a voltage follower 73. The resulting signal VMON is directly proportional to VRECT and is supplied to the ADC on microcontroller 30 via conductor 74. Microcontroller 30 monitors the current flowing through switch 99 by monitoring the voltage drop across current sense resistor 40 using voltage detecting circuitry 75-80. The resulting voltage signal IMON has a magnitude that is directly proportion to the current flowing through switch 99. Signal IMON is supplied to the ADC on microcontroller 30 via conductor 81. Microcontroller 30 detects zero-crossings of the 230 volt AC signal indirectly via voltage divider circuitry 82-85. The divided down voltage signal ZXMON is supplied to microcontroller 30 via conductor 86. Power supply circuit 28 supplies a 3.3 volt DC power supply voltage to microcontroller 30 and to RF transceiver integrated circuit 31 via conductor 87.

Figure 12:
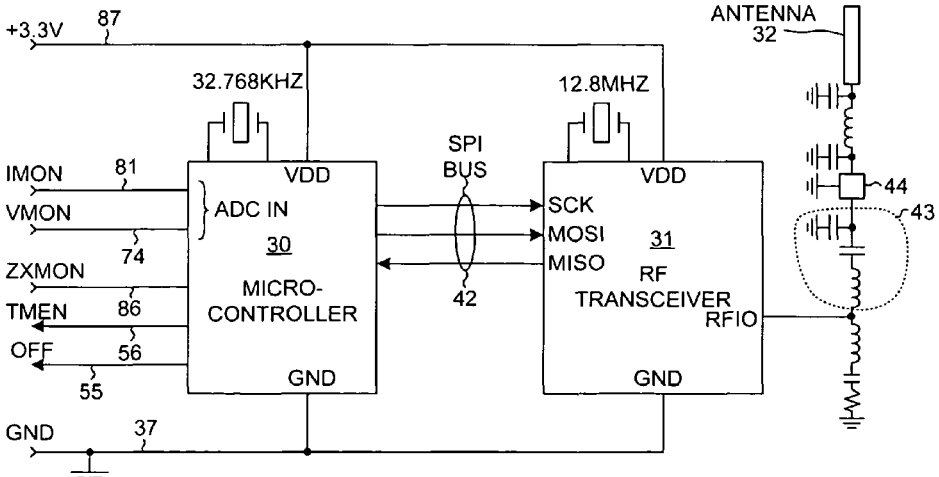
FIG. 12 is a circuit diagram of a second portion of the starter unit of FIG. 10.

FIG. 12 is a simplified circuit diagram that shows microcontroller 30 being interfaced via SPI serial bus and conductors 42 to RF transceiver integrated circuit 31. The starter unit 6 can both receive and transmit RF signals via transceiver 31 and antenna 32.

In the turning off of fluorescent lamps using starter units, it has been recognized that when one of the two ballasts of a multi-lamp light fixture is of the L-type and the other of the two ballasts is of the C-type, that one of the two lamps may be turned off first. This may, for example, be due to the different type of turn off timing employed to turn off one lamp versus the other lamp. The first lamp may be turned off satisfactorily, but when the second lamp is then turned off then the on-state of the second lamp or the turn off of the second lamp may cause the first lamp to be ignited again. This may be due to electromagnetic interference from the second lamp turn off being received by the circuitry of the first lamp. In turn, in some cases, the first lamp being restarted may in turn cause the second lamp to be restarted at a later time. Regardless of the mechanism at work, a reliable solution to this problem is desired.

Figure 13:
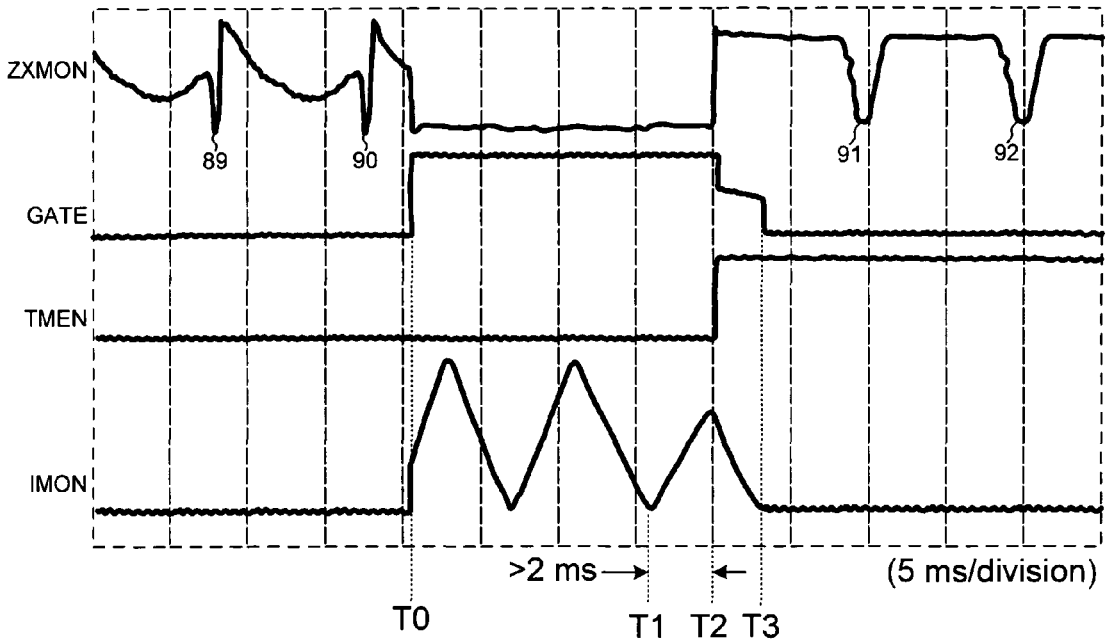
FIG. 13 is a waveform diagram that illustrates how the switch of the starter unit is made to pulse on and off in a C-type timing turn off operation.

FIG. 13 is a waveform diagram that shows waveforms of signals in the turning off of a lamp using the starter unit 6 in a situation in which the ballast to which it is coupled is a C-type ballast. See for example, ballast 46 of FIG. 11 where the C-type ballast 46 is used rather than the L-type ballast 17. In the waveform diagram of FIG. 17, the signal ZXMON is the voltage signal on conductor 86, the signal GATE is the voltage signal on node 88 on the gate of transistor switch 99, the signal TMEN is the voltage clamp enable signal on conductor 56, and the signal IMON is the signal on conductor 81 that is proportional to the current flowing through switch 99. When the lamp 4 is to be turned off, the microcontroller 30 monitors the ZXMON signal to determine when a zero crossing of the AC mains signal occurs. The troughs 89-92 of the ZXMON signal indicate these times. At or slightly following one of the times, microcontroller 30 drives the digital signal OFF to a digital low. In the example of FIG. 13, this results in the gate signal GATE transitioning high at time T0 2.5 milliseconds after the zero crossing. Switch 99 is therefore turned on, and effectively shorts the nodes 36 and 37 across full-wave rectifier 35. The voltage ZXMON therefore falls to zero. The current through switch 99 as indicated by signal IMON in FIG. 13 rises and falls with a periodic wave shape that corresponds to a rectified sinusoidal wave shape because the AC signal supplied to the full-wave rectifier 35 input nodes is an AC signal. In the example of FIG. 13, the wave shape of the rectified sinusoid half-cycles of IMON are more pointed than the peaks of an ordinary rectified AC sinusoid.

Microcontroller 30 monitors the periodic IMON signal by taking ADC samples at a rate of about two hundred samples during the next twenty milliseconds. The microcontroller analyzes these samples to detect when the IMON signal reaches its minimum value at time T1 after having risen and fallen twice since time T0. Starting at time T1, microcontroller 30 waits a predetermined amount of time (for example, four milliseconds) and then initiates turn off of switch 99 by asserting the TMEN signal high at time T2. This causes the gate voltage on the gate of transistor 99 to decrease as illustrated such that transistor 99 begins operating in the linear mode. The high voltage VRECT on node 36 through clamp circuit 67-70 maintains the voltage on the gate of transistor 99 so that transistor 99 remains in the linear mode. VRECT decreases as energy drains from the ballast. When VRECT has decreased to a predetermined voltage (for example, 396 volts), then the clamp circuit 67-70 stops conducting current to node 88. The voltage on the gate of transistor 99 transitions to zero volts at time T3. This turns transistor 99 off. (The putting of switch 99 into the linear mode for a short amount of time so that shortly thereafter the gate voltage decreases to turn off the switch fully are sometimes generally referred to together as the turning "off" of the switch even though more properly considered the turn off operation actually involves a linear mode operation of short duration followed by switch turn off.)

Figure 14:
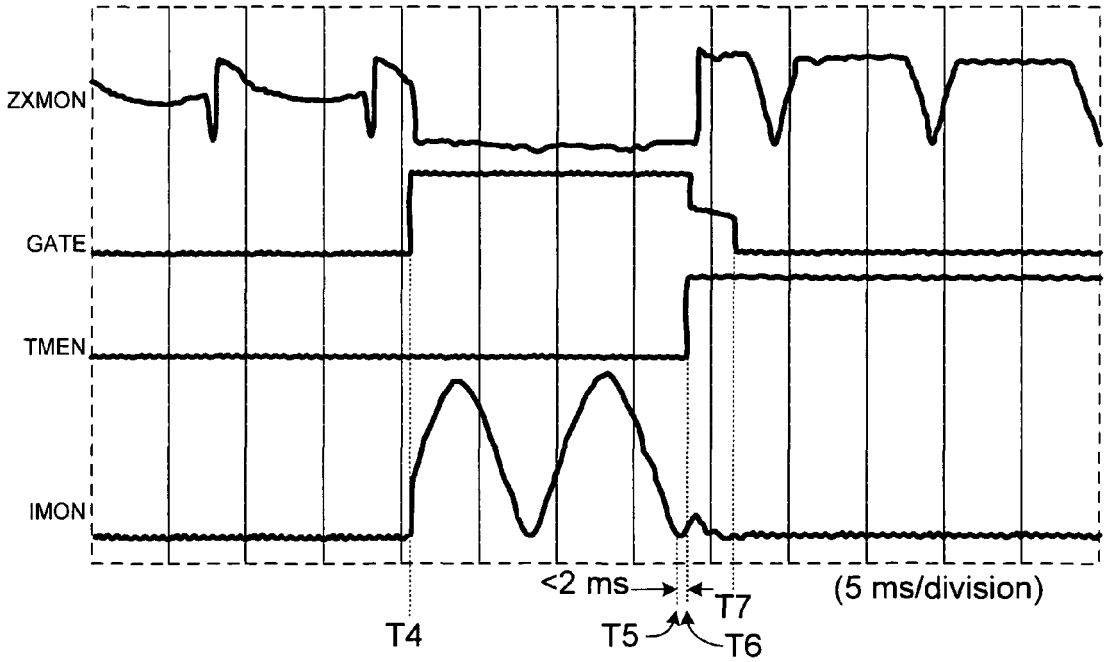
FIG. 14 is a waveform diagram that illustrates how the switch of the starter unit is made to pulse on and off in an L-type timing turn off operation.

FIG. 14 is a waveform diagram that shows waveforms of signals in the turning off of a lamp using the starter unit 6 in a situation in which the ballast to which it is coupled is an L-type ballast. See for example, ballast 17 of FIG. 11. Microcontroller 30 monitors ZXMON and determines when a zero crossing of the AC signal occurs. At or slightly following one of the times, microcontroller 30 drives the digital signal OFF to a digital low, thereby asserting the gate signal GATE on node 88 high at time T4. Switch 99 is turned on. The voltage ZXMON therefore falls to zero. The current through switch 99 as indicated by signal IMON in FIG. 14 rises and falls with a periodic wave shape that corresponds to a rectified sinusoidal wave shape. In the example of FIG. 14, the wave shape of the high peaks of IMON more closely resemble rectified sinusoid wave shapes than do the peaks in the waveform of FIG. 13.

Microcontroller 30 monitors the IMON wave by taking ADC samples and determines when the IMON signal reaches its minimum value at time T5 after having risen and fallen twice since time T4. Rather than waiting four milliseconds as in the example of FIG. 13, the microcontroller 30 asserts the TMEN signal high right away at time T6. In one example, the difference between times T1 and T2 in the situation of FIG. 13 is more than two milliseconds whereas the difference between times T5 and T6 in the situation of FIG. 14 is less than two milliseconds. The asserting of TMEN high causes the gate voltage on the gate of transistor 99 to decrease such that transistor 99 begins operating in the linear mode. The high voltage VRECT on node 36 through clamp circuit 67-70 maintains the voltage on the gate of transistor 99 so that transistor 99 remains in the linear mode. VRECT decreases as energy drains from the ballast. When VRECT has decreased to a predetermined voltage (for example, 396 volts), then the clamp circuit 67-70 stops conducting current to node 88. The voltage on the gate of transistor 99 transitions to zero volts at time T7. This turns transistor 99 off.

It has been found that using the turn off timing of FIG. 14 with L-type ballasts works better than does using the turn off timing of FIG. 13 with L-type ballasts. It has been found, however, that using the turn off timing of FIG. 14 with C-type ballasts can cause catastrophic failures of the switch transistor. If the switch 99 were to be controlled to begin turning off when the IMON signal was at its second minimum, then there would likely be too much energy remaining in the C-type ballast. When the switch is then put into its linear mode, the large amount of energy would overheat and destroy the switch transistor 99. The wait time between T1 and T2 in the timing of FIG. 13 is provided so that there will be less energy remaining in the ballast when switch 99 is put into the linear mode. Accordingly, the first type of timing is generally better for C-type ballasts and the second type of timing is generally better for L-type ballasts. To avoid the later turned-off lamp in a multi-lamp fixture from turning back on the other lamp that was just turned off, a method of using C-type timing to turn off both types of ballasts in a multi-lamp fixture has been used but sometimes the timing is such that lamps operating with L-type ballasts are not reliably turned off. Moreover, the starter unit does not have a way to determine if it is in a multi-lamp fixture or not, and therefore the L-type timing cannot be used even in situations in which the starter is not operating in a multi-lamp fixture.

Figure 15:
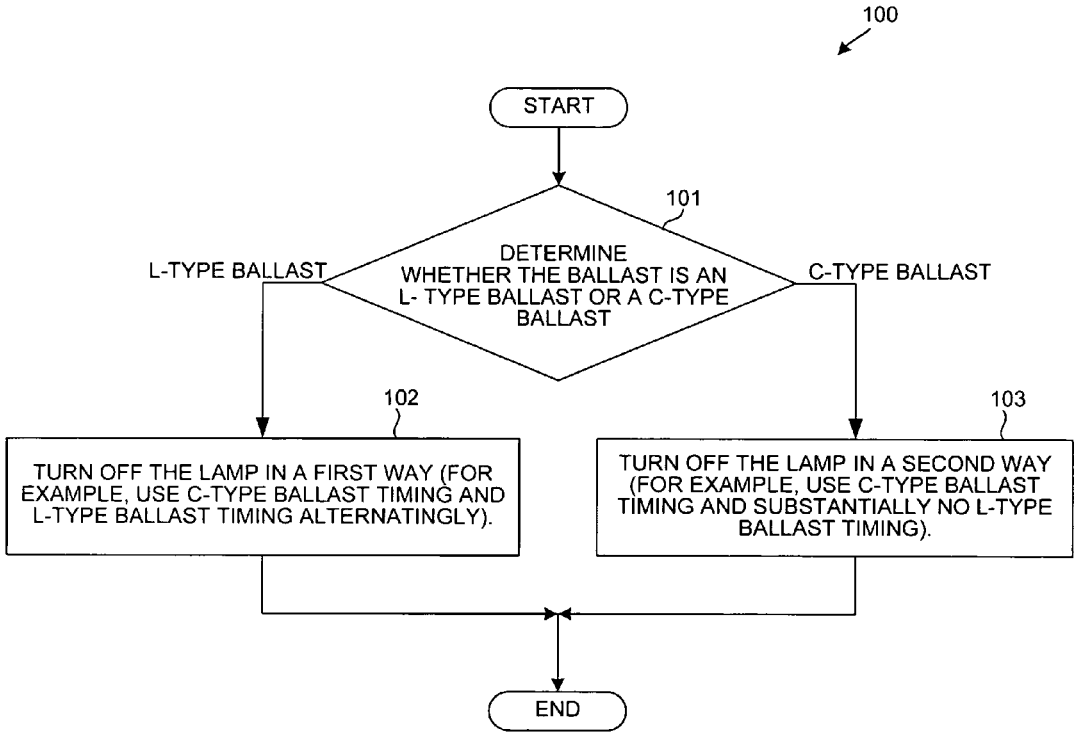
FIG. 15 is a flowchart of a method 100 in accordance with one novel aspect.

FIG. 15 is a flowchart of a method 100 in accordance with one novel aspect. In a first step (101), the starter unit makes a determination as to whether the ballast coupled to the starter unit is likely an L-type ballast or is likely a C-type ballast. In one example, this determination is made in a new way as set forth in connection with FIGS. 16 and 17. If the determination is that the ballast is likely an L-type ballast, then the lamp is turned off in a first way (step 102) in a subsequent turn off operation. This first way may involve performing a sequence of multiple turn off operations, using C-type timing and L-type timing alternatingly from turn off operation to turn off operation, starting with a C-type timing. Where a C-type timing is denoted "C" with a capital C, and where an L-type timing is denoted "L" with a capital L, the pattern of timings used in a sequence of turn off operations may be a mix of timings such as "CLCCLCLC" for a number of attempts. If the lamp is not successfully extinguished, then the pattern may switch to another pattern, for example "CLCCCCCC". The patterns are read left to right.

If, however, the determination in step 101 is that the ballast is likely a C-type ballast, then the lamp is turned off in a second way (step 103) in a subsequent turn off operation. This second way may involve performing a sequence of multiple turn off operations using C-type timing and substantially no L-type timing. By not using L-type timing, the risk of using L-type timing in combination with a C-type ballast and thereby destroying switch 99 in the starter unit is avoided. The pattern of timings used in a sequence of turn off operations may be designated "CCCCCCCC".

Accordingly, if a C-type ballast and an L-type ballast are both provided in a multi-lamp fixture, then there will be times when attempts are being made to turn off both lamps of the multi-lamp fixture using the same C-type timing. The simultaneous turn off of both lamps reduces to incidence of a later turn off operation from re-igniting a previously turned off lamp. Also, in the event a lamp coupled to an L-type ballast is not turned off using the weaker C-type timing, there will be a time when at attempt is made to turn off that lamp using L-type timing. The same method 100 is carried out in a starter unit, regardless of whether the starter unit is employed in a multi-lamp light fixture or is employed in a single-lamp light fixture.

Figure 16:
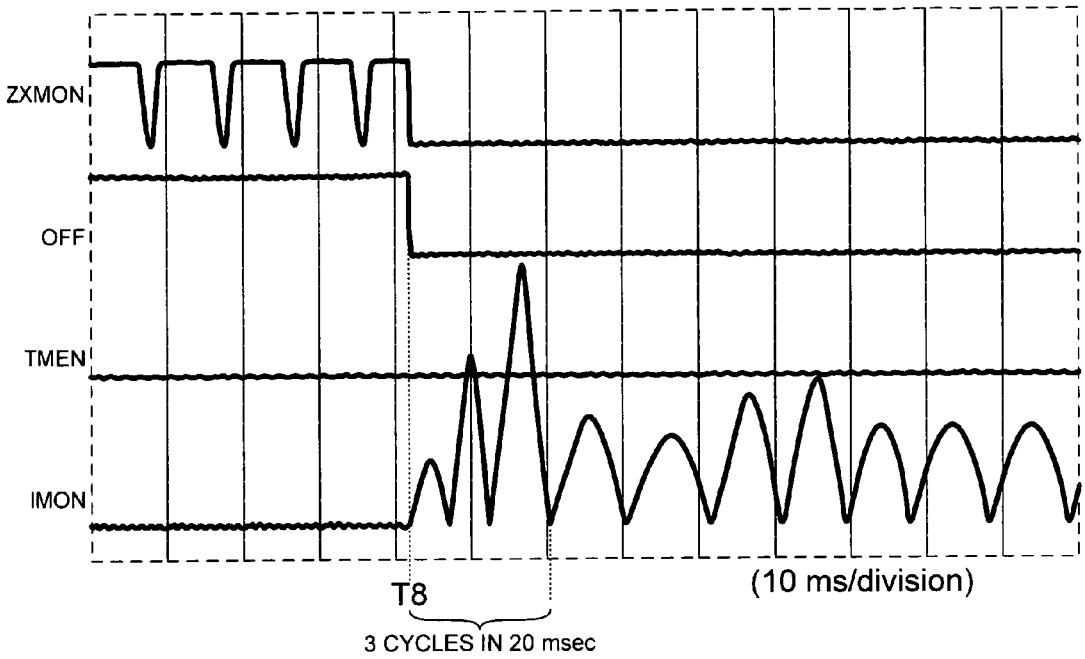
FIG. 16 is a waveform diagram of a transient response due to a C-type ballast. The starter unit detects this transient response and analyzes it and thereby determines that the starter unit is likely coupled to a C-type ballast.
Figure 17:
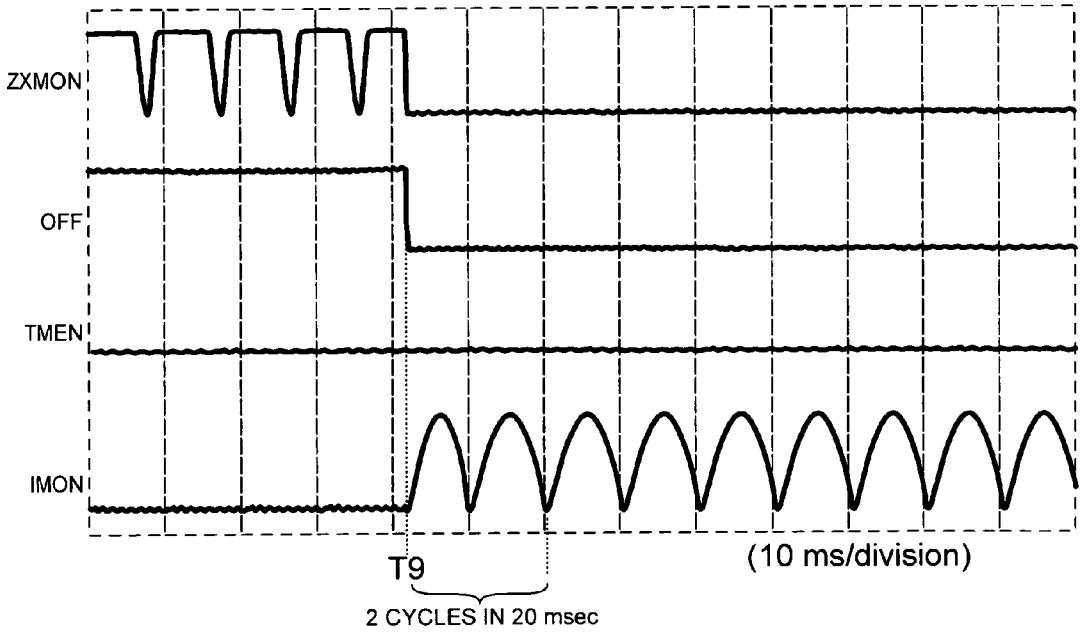
FIG. 17 is a waveform diagram of a transient response due to an L-type ballast. The starter unit detects this transient response and analyzes it and thereby determines that the starter unit is likely coupled to an L-type ballast.

FIGS. 16 and 17 are waveform diagrams that illustrate a novel way that the determination of the type of ballast can be made in step 101. Previously in the art attempts were made to determine ballast type based on differences in the saddle portion of the wave shape of the ZXMON signal. In FIG. 13, for example, notice that between troughs 89 and 90 the ZXMON wave shape has more of a saddle than does the ZXMON signal in FIG. 14. The differences between the high voltage during this saddle time and the low voltage during this saddle time was used in an attempt to detect whether the ballast was an C-type ballast or an L-type ballast, but this previously used method was unreliable.

In the novel method set forth in FIGS. 16 and 17, the saddle shape of the ZXMON signal is not used but rather the periodicity of the IMON signal is detected and used as an indicator of the ballast type. The different ballast types are used to affect power factor and therefore the ballasts typically have different natural harmonic oscillating frequencies. In general, the capacitor of the C-type ballast is not small and has a fixed relationship with respect to the inductance L of the ballast for a given AC power signal frequency. For example, in a fifty hertz example for a 36 watt lamp, the inductance of the inductor in the C-type ballast may be 3.4 microhenrys and the series capacitance in the C-type ballast may be 3.4 microfarads. But regardless of the reason, the transient oscillatory response of current flow through the ballast and lamp back into the starter unit as a result of switching on of switch 99 is seen to differ depending on whether a C-type ballast is used or whether an L-type ballast is used. The magnitude of the period of the transient response is related to the natural oscillating frequency of the ballast, and is therefore indicative of whether the ballast is a C-type ballast or an L-type ballast.

FIG. 16 is a waveform diagram that shows the transient response of IMON that is detected by microcontroller 30 to determine that the ballast is likely a C-type ballast. In a preheat operation, the switch 99 is turned on as a result of the signal OFF transitioning low at time T8. Switch 99 is turned on so that current flows through the full-wave rectifier 35. Three rectified sinusoidal wave shapes are then seen in the IMON signal over the next twenty milliseconds as illustrated. This is a transient response and over time the period of the IMON signal settles to match the fifty hertz forced response due to the starter unit being driven with a fifty hertz AC signal. Microcontroller 30, however, monitors the IMON signal during the first twenty milliseconds. If it detects a first periodicity of IMON (for example, more than two pulses of IMON during this twenty millisecond time as illustrated in FIG. 16) then it determines that the ballast is likely a C-type ballast.

FIG. 17 is a waveform diagram that shows the transient response of the IMON signal that is detected by microcontroller 30 to determine that the ballast is likely an L-type ballast. In the preheat operation, the switch 99 is turned on at time T9. Microcontroller 30 monitors the IMON signal and if it detects a second periodicity of the IMON signal (for example, two pulses of IMON during the next twenty millisecond time) then microcontroller 30 determines that the ballast is likely an L-type ballast. Although the determining of the periodicity of the transient response is described here as occurring in a preheat cycle, this is just an example. The determination of the periodicity of the transient response may be performed at other times such as in response to the turning on of switch 99 during a lamp turn on or turn off operation. It is to be understood that the description of the operation of the fluorescent lamp light fixture and starter unit is a simplification. For a more detailed and accurate description and understanding, the actual detailed circuit can be built and/or simulated using a circuit simulator such as SPICE.

For additional details on how starter units turn off fluorescent lamps without using a wall switch and for details on RF-enabled starter units in a lighting system, see: 1) U.S. patent application Ser. No. 12/587,152 entitled "Registering A Replaceable RF-Enabled Fluorescent Lamp Starter Unit To A Master Unit," filed on Oct. 1, 2009, 2) U.S. patent application Ser. No. 12/587,130 entitled "Turning Off Multiple Fluorescent Lamps Simultaneously Using RF-Enabled Lamp Starter Units," filed on Oct. 3, 2009, 3) U.S. patent application Ser. No. 12/587,169 entitled "Dimming A Multi-Lamp Fluorescent Light Fixture By Turning Off An Individual Lamp Using A Wireless Fluorescent Lamp Starter," filed on Oct. 3, 2009, and 4) U.S. patent application Ser. No. 12/802,090 entitled "Rejecting Noise Transients While Turning Off A Fluorescent Lamp Using A Starter Unit," filed on May 28, 2010, by Kamlapati Khalsa and Roger Ball, Express Mail EB995603272US (The subject matter of all four patent documents is incorporated herein by reference).

Although certain specific embodiments are described above for instructional purposes, the teachings of this patent document have general applicability and are not limited to the specific embodiments described above. Although system 1 for turning off a fluorescent lamp wirelessly using starter units is described as being powered by a 230-volt, fifty hertz AC mains voltage, system 1 can also be implemented in other electrical power environments. For example, starter units 6 and 7 can be used to turn off fluorescent lamps that are powered by sixty hertz alternating current. System 1 can be implemented equally well in different electrical power environments, such as those of North America and Europe. The starter unit functionality can be incorporated into other components such as ballasts and need not be provided as a replaceable unit of the form factor illustrated in FIG. 9. Accordingly, various modifications, adaptations, and combinations of various features of the described embodiments can be practiced without departing from the scope of the invention as set forth in the claims.

What is claimed is:

1. A method comprising:

(a) making a determination whether a ballast coupled to a fluorescent lamp is of a first type or whether the ballast is of a second type, wherein the determination is made in a fluorescent lamp starter circuit at least in part by determining a periodicity of a periodic current flowing through the ballast;

(b) if the determination in (a) is that the ballast is of the first type then controlling a switch in the fluorescent lamp starter circuit to turn off the fluorescent lamp in a first way; and (c) if the determination in (a) is that the ballast is of the second type then controlling the switch to turn off the fluorescent lamp in a second way.

2. The method of claim 1, wherein the ballast of the first type is an L-type ballast, wherein the ballast of the second type is a C-type ballast, wherein the periodicity of the periodic current in (a) is determined during a lamp preheating operation, wherein the first way involves initiating turning off of the switch during a lamp turn off operation at a time when a periodic current flowing through the switch is approximately at a minimum, and wherein the second way involves initiating turning off of the switch during the lamp turn off operation at a time more than two milliseconds after the periodic current was at a minimum.

3. The method of claim 1, wherein (a), (b) and (c) are performed by the fluorescent lamp starter circuit when the fluorescent lamp starter circuit is receiving AC mains power.

4. A method comprising:

(a) making a determination whether a Fluorescent Lamp Starter Unit (FLSU) is coupled to an L-type ballast or whether the FLSU is coupled to a C-type ballast;

(b) if the determination in (a) is that the FLSU is coupled to a L-type ballast then controlling a switch in the FLSU to turn off a fluorescent lamp by pulsing on and then off using first pulses that have a first timing and also using second pulses that have a second timing; and (c) if the determination in (a) is that the FLSU is coupled to a C-type ballast then controlling the switch to turn off the fluorescent lamp by pulsing on and then off using third pulses that have the second timing and using substantially no pulses that have the first timing.

5. The method of claim 4, wherein a periodic current flows through the switch when the switch is pulsed on, wherein the first timing involves initiating turn off of the switch by changing a voltage on a control electrode of the switch at a time when the periodic current is approximately at a minimum, and wherein the second timing involves initiating turn off of the switch by changing the voltage on the control electrode of the switch at a time more than two milliseconds after the periodic current was at a minimum.

6. The method of claim 5, wherein the periodic current has a wave shape approximating a full-wave rectified sinusoidal wave, wherein the sinusoidal wave before rectification has a frequency in a range of from approximately forty to seventy hertz.

7. The method of claim 4, wherein a periodic current flows through the switch when the switch is pulsed on, wherein the first timing involves initiating turn off of the switch by changing a voltage on a control electrode of the switch when the periodic current is approximately at a minimum, and wherein the second timing involves changing the voltage on the control electrode of the switch when the periodic current is not at a minimum.

8. The method of claim 4, wherein a periodic current flows through the switch when the switch is pulsed on, wherein the first timing involves initiating turn off of the switch by putting the switch into a linear mode when the periodic current is approximately at a minimum, and wherein the second timing involves putting the switch into the linear mode when the periodic current is not at a minimum.

9. The method of claim 4, wherein the determination in (a) is made by turning on the switch and thereby generating a transient response in a current flowing through the switch, and by making a measurement of the transient response.

10. The method of claim 4, wherein the determination in (a) is made by making a measurement indicative of a period, and wherein the period is a period whose magnitude is related to a natural oscillating frequency of the ballast.

11. The method of claim 4, wherein the determination in (a) is made by turning on the switch in a preheat operation and thereby causing a current to flow through the switch, and by making measurements indicative of a magnitude of the current, and by analyzing the measurements.

12. The method of claim 4, wherein the determination in (a) involves determining a periodicity of a transient periodic current flowing through the switch.

13. The method of claim 4, further comprising:

(d) if the determination in (a) is that the FLSU is coupled to a L-type ballast then using a first sequence pattern of pulses during a first time period, and then using second sequence pattern of pulses during a second time period, wherein the first sequence pattern is a sequence that involves some pulses that have the first timing and that involves other pulses that have the second timing, and wherein the second sequence pattern is a sequence that involves some pulses that have the first timing and that involves other pulses that have the second timing, wherein the first and second patterns involve different mixes of first and second timing pulses.

14. The method of claim 4, wherein the FLSU is coupled to a ballast through the fluorescent lamp.

15. A method comprising:

(a) turning on a switch in a fluorescent lamp starter unit (FLSU) and thereby establishing a current path, wherein the current path extends through a ballast, through a fluorescent lamp, and through the switch, wherein the turning on of the switch causes a transient periodic current to flow in the current path through the switch;

(b) making at least one measurement of the transient periodic current;

(c) using the measurement of (b) to make a determination; and (d) turning off the fluorescent lamp using the FLSU while the FLSU is receiving AC mains power, wherein (a), (b), (c) and (d) are performed by the FLSU.

16. The method of claim 15, wherein the determination of (c) determines how the switch will be controlled in the turning off of the fluorescent lamp in (d).

17. The method of claim 15, wherein the determination of (c) involves a determination of a periodicity of the transient periodic current.

18. The method of claim 15, wherein the determination of (c) involves a determination of whether the ballast is an L-type ballast or whether the ballast is a C-type ballast.

19. The method of claim 15, wherein (a) occurs as part of a preheating operation.

20. The method of claim 15, wherein the lamp is turned off in (d) during a lamp turn off operation, wherein during the lamp turn off operation the switch is turned on, and then the switch is put into a linear mode, and then the switch is turned off.

* * * * *